United States Patent [19]

Criscimagna et al.

[11] 3,973,253

[45] Aug. 3, 1976

[54] FLOATING ADDRESSING SYSTEM FOR GAS PANEL

[75] Inventors: Tony N. Criscimagna, Woodstock; Albert O. Piston, Catskill, both of N.Y.

[73] Assignee: International Business Machines Corporation, Armonk, N.Y.

[22] Filed: Jan. 10, 1974

[21] Appl. No.: 432,279

Related U.S. Application Data

[63] Continuation of Ser. No. 238,572, March 27, 1972, abandoned, and a continuation-in-part of Ser. No. 885,086, Dec. 15, 1969, abandoned.

[52] U.S. Cl. ..... 340/324 M; 315/169 TV; 340/166 EL

[51] Int. Cl.[2] ..... H01J 17/48

[58] Field of Search ..... 340/324 M

[56] References Cited

UNITED STATES PATENTS

| | | | |
|---|---|---|---|
| 3,513,327 | 5/1970 | Johnson | 307/89 |
| 3,526,711 | 9/1970 | Boer | 340/324 M |
| 3,559,190 | 1/1971 | Bitzer et al. | 340/324 M |
| 3,573,542 | 3/1971 | Mayer et al. | 315/169 R |
| 3,609,746 | 9/1971 | Trogdon | 340/324 M |
| 3,614,739 | 10/1971 | Johnson | 340/166 R |
| 3,618,071 | 11/1971 | Johnson et al. | 340/324 M |
| 3,668,688 | 6/1972 | Schmersal | 340/324 M |
| 3,671,938 | 6/1972 | Ngo | 340/166 R |
| 3,761,897 | 9/1973 | Tech | 340/173 PL |

*Primary Examiner*—David L. Trafton
*Attorney, Agent, or Firm*—Joseph J. Connerton

[57] ABSTRACT

A system for addressing and controlling a gaseous discharge display or memory device is adapted for intercommunication between a processor or controller, control logic and panel driving circuits in a gaseous discharge display system. By application of write and sustain signals to selected transverse conductors disposed on opposite sides of a gas filled panel, selected sites positioned at conductor intersections are discharged, emitting light, and the resultant display maintained by the wall charge phenomenon and sustain signals. Logic circuits and panel drive circuits are electrically floated on the sustain voltage for the panel whereby the sustain signal provides a common reference, thus permitting the use of low voltage circuits particularly adapted to integrated circuit packaging. Coupling means are employed to isolate the signals from the logic control from the panel selection, control and drive circuits, permitting control of the high voltage panel operation by low level coded signals. By utilizing a pulsed supply for line drivers rather than a fixed power supply, power and heat dissipation are further reduced, thereby facilitating integrated circuit packaging. The preferred embodiment of the present invention is adapted to write, sustain and erase a gaseous discharge panel.

13 Claims, 44 Drawing Figures

FLOATING ADDRESSING SYSTEM FOR GAS PANEL

CROSS REFERENCE TO RELATED APPLICATIONS

This is a continuation of application Ser. No. 238,572 filed Mar. 27, 1972, now abandoned, which was a continuation in part of application Ser. No. 885,086 "Improved Method and Apparatus for a Gas Display Panel", filed by T. N. Criscimagna and A. O. Piston, Dec. 15, 1969, and now abandoned.

BACKGROUND OF THE INVENTION

In gaseous discharge devices adapted for use as display or storage apparatus, arrays of parallel conductors oriented at transverse angles to each other are disposed on opposite sides of a gas filled panel, the conductors being insulated from direct contact with the gas by a layer of dielectric. One example of such a gaseous display is described in U.S. Pat. No. 3,559,190, "Gaseous Display and Memory Apparatus", issued Jan. 26, 1971, to Donald L. Bitzer et al and assigned to the University of Illinois. Individual discharge sites located at coordinate intersections on said panel are selectively fired by application of high voltage drive signals composed of write pulses algebraically added to alternating sustain signals. When thus fired, the resulting light emitted from the selected sides forms one element or dot of the desired display, and a plurality of fired cells in a specified configuration forms a display. Signals to control the selection of the individual cells to form a display are low voltage digital signals which may originate from a computer, teletype unit, telephone line, local or remote display control unit, etc., while the combined sustain and write signals required to fire or discharge a cell may extend 300 volts in amplitude. To fire a cell, as more fully described hereinafter, a write pulse signal in the order of 50 volts amplitude is algebraically added to the sustain signal in the order of 300 volts peak-to-peak to obtain a signal which exceeds the firing potential of the gas, since the sustaining voltage of itself is insufficient to initiate a discharge. The panel logic circuits and panel control signal power supplies are electrically floated on the sustain signal using the sustain signal as a reference. By referencing both the pulsing circuits and logic circuits to the sustain potential, low voltage circuits adapted for integrated circuit packaging may be used for pulsing and logic functions, thereby limiting high voltage signals to the sustain signal source. By utilizing integrated circuitry for the logic and control pulsing functions, the cost and size of these circuits are significantly reduced. By utilizing a pulsed supply for the write and erase functions, rather than a fixed power supply, power is utilized only when pulsing, thus providing an additional saving in power consumption with its concommitant heat dissipation. Isolation between the digital control signals and the high voltage operating signals is provided by transformer coupling, and the panel selection logic is adapted to provide group and sub-group selection, as for example, individual line selection for the respective rows of the display. The present invention provides a system for interfacing various signal levels, and by providing a common reference permits communication between a processor or control unit, logic and selection circuitry and high voltage panel driving circuitry.

In addition to the reference feature wherein the interfacing logic circuits and pulsing circuits are electrically floated on the sustain voltage for the panel, the present invention provides a low-cost apparatus for a gas display panel and a method to provide reliable write, sustain and erase operations. For sustain operation, a first square wave train is applied to all horizontal lines of the gas display panel simultaneously as a second square wave train displaced 90° from the first square wave train is applied to all vertical lines. For a write operation, the frequency of the first and second square wave trains is reduced and a pulse is superimposed or algebraically added to the sustain signals to provide a composite signal having an amplitude and duration sufficient to ionize the gas at a selected intersection. The superimposed signal increases the potential on a selected horizontal line, decreases the potential on the remaining horizontal lines, decreases the potential on a selected vertical line and increases the potential on the remaining vertical lines. The selected cell thus receives an increased potential difference sufficient to equal or exceed the firing potential after all the remaining cells receive a sustain potential which reignites all cells which were previously ignited. The algebraically added pulses cancel out the effect on each other across the half-select cells and the nonselected cells. For an erase operation a given signal of constant magnitude and polarity is applied to all horizontal lines and all vertical lines and a pulse is algebraically added on the given line which (a) increases the potential on a selected horizontal line, (b) decreases the potential on the nonselected horizontal lines, (c) decreases the potential on a selected vertical line, and (d) increases the potential on the nonselected vertical lines whereby no gas cell or site in the gas panel receives a potential difference sufficient to equal or exceed the sustain level. However, the selected gas cell, and only this gas cell, receives a potential difference having a polarity opposite to that of the last sustain signal and an amplitude that is just barely sufficient to fire the cell, and this is effective in reducing the wall charge across the selected gas cell substantially to zero. After a suitable time delay, referred to as dead time, the wall charge across the selected cell is reduced to zero, and the selected gas cell is thus returned to the extinguished state. A sustain operation then takes place which reignites all gas cells previously ignited before the erase operation except the selected erased cell. The algebraically added pulses cancel out the effect of each other across the half-selected cells and the nonselected cells.

Accordingly, it is a primary object of the present invention to provide improved interface and logic circuit arrangements for use with a gaseous discharge display/memory device.

It is a further feature of this invention to provide an improved gaseous discharge display system of high reliability having low voltage and power requirements for the logic and the panel driving circuitry and adapted for the use of integrated circuitry.

Another object of the present invention is to provide improved low voltage logic selection circuitry for a gaseous discharge device adapted to communicate with a low signal level processor and a high signal level sustain generator.

Still another object of the invention is to provide an improved gaseous discharge display control system in which low level logic and write pulsing circuitry are floated on the sustainer voltage of the gaseous discharge display device to permit integrated circuit packaging of the logic and panel driving circuits.

The foregoing and other objects, features and advantages of the present invention will be apparent from the following description of a preferred embodiment of the invention as illustrated in the accompanying drawings.

DESCRIPTION OF THE PREFERRED EMBODIMENT

Figure 1:
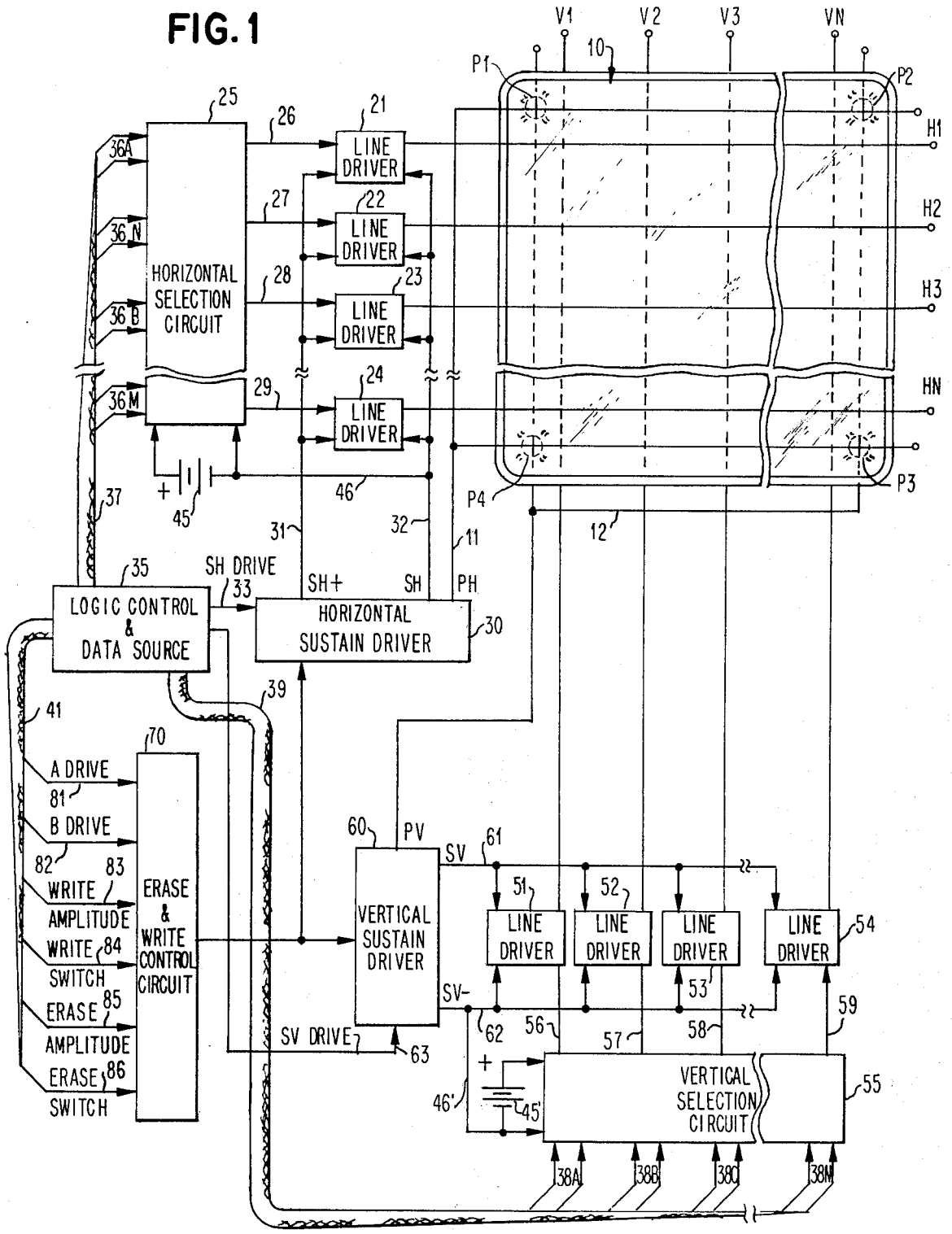
FIG. 1 illustrates a gaseous discharge display system according to this invention.

In a system according to this invention, a gas panel 10 has horizontal lines HI through HN disposed thereover and vertical lines VI through VN disposed therebeneath. The gas panel 10 may be of the physical honeycomb structure type shown and described in U.S. Pat. No. 3,559,190, referred to hereinbefore, or in the preferred embodiment an open type panel configuration of the type described in Column 9, lines 17–27, of the above referenced patent. Such gas panels include a thin gaseous discharge medium under pressure bounded by dielectric charge storage members where intersection of horizontal and vertical conductors define gas cells. The gas cells are selectively ignited, termed a write operation, by applying one potential to a horizontal line and an opposite potential to a vertical line, and the potential difference is sufficient to exceed the ignition potential of the illuminable gas. Once ignited, each gas cell is maintained in the ignited state by a periodic sustain signal on the vertical and horizontal lines of sufficient amplitude to equal or exceed the sustain level, but less than the ignition potential. Any one of the ignited cells may be extinguished, termed an erase operation, by first reducing the potential difference across the cell to zero, then applying a pulse of erase amplitude and polarity opposite that of the last sustain alternation, and last to maintain the zero potential for a fixed time period after the erase pulse. By selective writing operations, information may be displayed in the form of characters, symbols, lines (graphics) and the like on the gas panel 10 and such information may be regenerated as long as desired by the sustain operation. Displayed information then may be removed selectively by erase operations.

Lines 11 and 12 are disposed as shown to define four pilot cells P1 through P4. The pilot cells are ignited initially, and they remain ignited throughout the use of the gas panel 10. The pilot cells ionize the illuminable gas in the four corners of the gas panel 10, and this serves to provide a more uniform operation in the ignition of the remaining gas cells. The potential PH on the line 11 and the potential PV on the line 12 produce a potential difference sufficient to fire and sustain the pilot cells P1 through P4 at all times during the operation of the gas panel 10.

Line drivers 21 through 24 supply operating potentials to respective horizontal lines HI through HN. A horizontal selection circuit 25 provides a signal of a given polarity from a latching function on a selected one or more of the lines 26 through 29 thereby to select a given one or more of the line drivers 21 through 24 for a write or erase operation. The horizontal sustain driver 30 provides a high voltage operating signal on a bus 31 and a bus 32 for controlling the operation of the line drivers 21 through 24. In other words, depending on the polarity of the control signals 26–29, either a half-select signal SH+ or a half-select cancellation signal SH− will be directed through each of the line drivers 21–24, and the identical operation takes place in the vertical direction. Input control signal is supplied on a line 33 labeled SH drive to the sustain driver 30.

Line drivers 51 through 54 supply operating potentials to respective vertical lines VI through VN. A vertical selection circuit 55 provides a signal of a given polarity from a latching function on a selected one of the lines 56 through 59 thereby to select a given one or more of the line drivers 51 through 54 for a write or erase operation. The vertical sustain driver 60 supplies a high voltage operating signal on a bus 61 and a bus 62 to the line drivers 51 through 54. The sustain driver 60 receives a control input signal on a line 63 labeled SV drive.

The sustain driver 30 and the sustain driver 60 also receive control signals from an erase and write control circuit 70 whenever an erase or write operation takes place. At all other times the sustain driver 30 and the sustain driver 60 perform sustain operations in response to the control signals on respective input lines 33 and 63. The erase and write control circuit 70 receives control signals on lines 81 through 86 for performing write and erase operations. The lines 81 through 84 receive control signals for performing a write operation, and the lines 81, 82, 85 and 86 receive control signals for performing an erase operation. The control signals applied to the lines 81 through 86 during write and erase operations are discussed more fully hereinafter with reference to FIGS. 3, 4 and 5.

From a system aspect, it is seen that signals to the horizontal and vertical selection circuits 25 and 55 respectively originate from a source 35 labeled logic control and data source. Such a device might comprise a data processor or display controller, the specific details of which have been omitted in the interest of clarity since they are considered beyond the scope of the instant invention. A plurality of coded signals on conductors 36A, 36N, 36B, 36M, are applied from the data source 35 via cable 37 to the horizontal selection circuit 25, while similar control signals are applied via control lines 38A–38N and cable 39 to the vertical selection circuit 55. Finally, the individual drive, write and erase commands or control signals 81–86 are applied from the logic control and data source 35 via cable 41 to the erase and write control circuit 70, the operation of which is more fully described hereinafter. Associated with the horizontal and vertical selection circuits 25 and 55 are power supplies 45, 45′ which in reality might comprise two low voltage power supplies having a nominal rating of approximately 5 volts. The power supplies 45, 45′ are referenced to outputs 32, 62 from associated sustain drivers 30, 60, respectively, whereby the low voltage power supplies 45, 45′ are electrically floated on the sustain signal. Likewise, line drivers 21–24 and 51–54, which generate panel drive signals of 50-volt magnitude to modify the sustain signal in write and erase operations, are connected via lines 31, 32 and 61, 62 to electrically float on the sustain signals. Thus the horizontal selection circuit 25 and the vertical selection circuit 55 may be low voltage circuits. Without the sustain reference, high voltage circuits having high power consumption and heat generating characteristics would be required for the selection logic and line driver circuits. By using the sustain as the reference, circuits are well within the range of integrated circuit packaging. By floating the logic and panel driving circuitry in the above described manner, addressing selected sites can be accomplished with low voltage signals, and the selection logic and panel driving circuits can be integrally combined. As more fully described with reference to FIG. 2, the logic circuitry includes selector circuitry for selecting groups or subgroups of panel conductors to which high voltage manipulating pulses are applied.

Figure 2C:
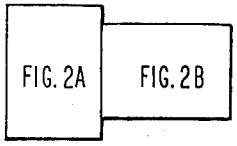
FIG. 2C shows how FIGS. 2A and 2B should be arranged.
Figure 2:
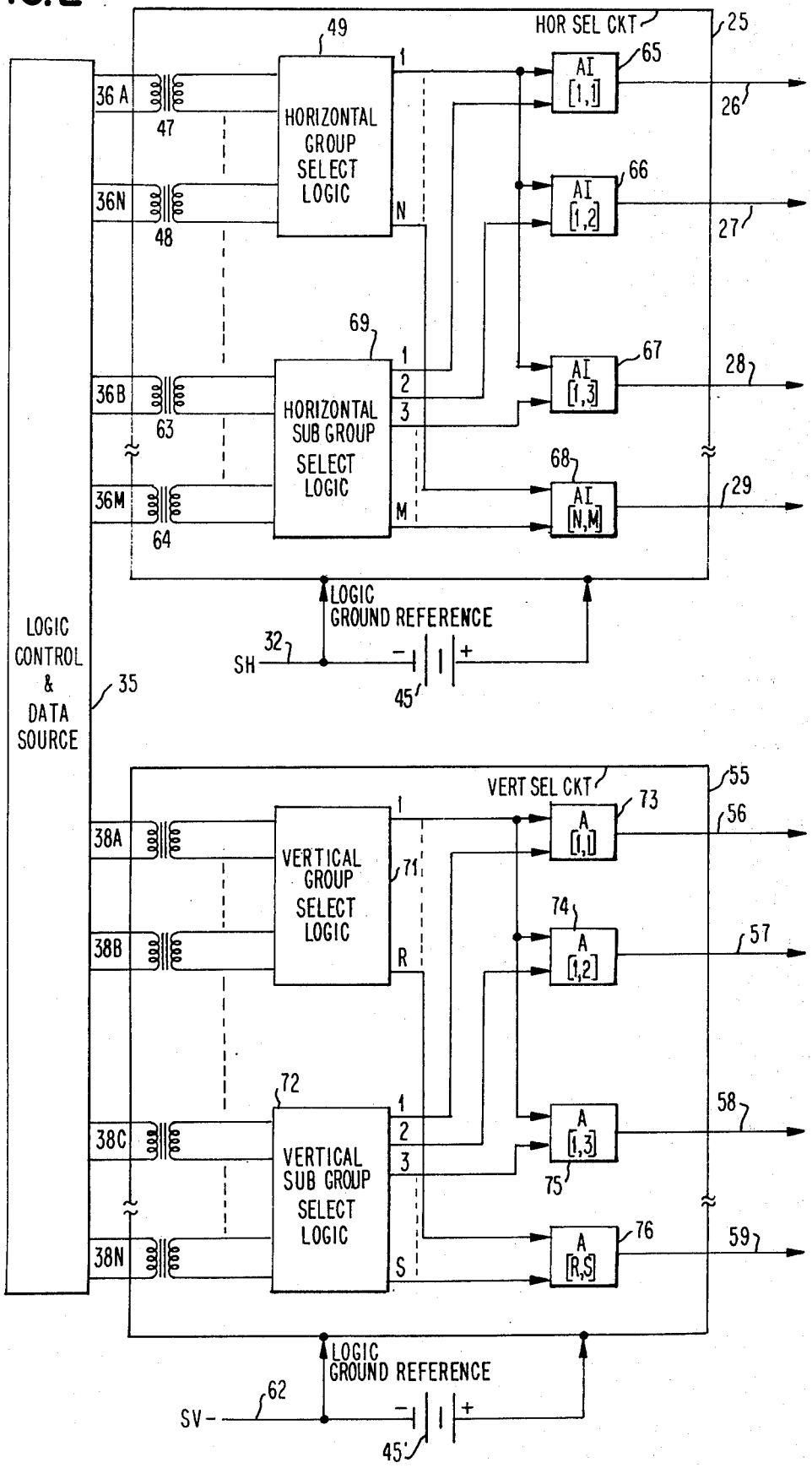
FIG. 2 illustrates details of the selection logic and related circuitry shown in block form in FIG. 1.

Referring now to FIG. 2, there is illustrated in logical block form the horizontal and vertical selection circuits shown as blocks 25 and 55 respectively in FIG. 1. Since the horizontal and vertical selection logic operate in substantially the same manner, the operation of the horizontal selection circuit will be described by way of example.

The arrangement in FIG. 1 illustrated a panel having N horizontal and vertical lines, the respective intersections designating cells. In a practical display embodiment, a display would normally have a number of rows of characters, each row having a predetermined character capacity. A typical gas panel might comprise a 480-character display which would comprise 12 rows of 40 characters, 8 rows of 60 characters, etc. Assuming the 12-row 40-character format, the horizontal logic would be required to designate the row of characters to be displayed followed by the respective lines within the row. The rows might be designated groups, the individual lines comprising the character dots subgroups. For example, using a 7 × 9 dot matrix per character, 9 lines per row of characters would be required.

The inputs to the horizontal selection logic comprises conductors 36A, 36N, which are coupled through transformers 47, 48 to horizontal group select logic 49, while conductors 36B, 36M are connected through transformers 63, 64 to horizontal sub-group selection logic 69. While transformer coupling is employed to isolate the data source from the selection logic, it will be appreciated that other forms of coupling such as photonic coupling may be used. The coded information applied to horizontal group select logic 49 will be decoded in a conventional manner to selectively activate outputs I through N which in turn conditions associated And Invert circuits 65–68. The second input to the And Invert logic circuits 65–68 is provided by the horizontal sub-group selection logic 69, which activates output lines l–M in accordance with the coded data applied via lines 36B–36M. Thus And Invert circuits 65, 66, 67 identify the first three lines of group 1, while And Invert circuit 68 represents the M line of group N. In the particular logic configuration employed herein, the number of And Invert circuits is equal to the number of horizontal drive lines. Using the previously identified format of 12 rows of 7 × 9 characters, 108 And Invert circuits would be required to supply a corresponding number of line drivers. The outputs 26–29 from the respective logical And Invert circuits 65–68 comprise inputs to line drivers 21–24 as illustrated in FIG. 1. The coded information applied to horizontal sub-group selection logic 69 is also decoded in a conventional manner to selectively activate output lines l–M. In generating characters using a horizontal stroke technique for example, the output lines l–M would be conditioned in sequence and a plurality of vertical lines as selected by the vertical group select logic 71 and the vertical sub-group select logic 72 could be conditioned prior to each write operation to write a character slice or line. However, the particular character generation technique is not germane to the invention, and any technique of providing a discharge and/or sustain signal to the selected cells may be utilized. The sustain signal SH which originates from the horizontal sustain driver 30 (FIG. 1) is applied via conductor 32, and functions as the logic ground reference for logic power supply 45. The logic power supplies 45, 45′, are shown connected to the selection circuits 25, 55 in the interest of clarity, although it will be appreciated that in practice the power supplies will be connected to the individual logic circuits in a conventional manner.

In like manner, the vertical selection circuit 55 comprises a vertical group select logic element 71 and a vertical sub-group select logic element 72 to generate the signals 56–59 required to activate column line drivers 51–54 (FIG. 1) respectively. Vertical group select logic is shown as having outputs l–R, while the subgroup select logic has outputs l–S. Logical And circuits 73–76 provide positive outputs when energized by positive inputs; logic And Invert circuits 65–68 provide negative output when energized by positive inputs. One-half of the required sustaining potential may be applied to horizontal conductors Hl–HN and one-half the potential applied to vertical conductors Vl–VN, and logic And and And Invert circuits function to provide the proper polarity for operating the line driver circuitry to selectively generate write or erase signals. The integrated circuits comprising the selection logic and the panel driving circuits could be mounted on a separate circuit board or on the panel itself without deviating from the invention. Obviously, the drive circuits would be mounted as closely as possible to the lines to be driven, and the panel could be driven from either side or from alternate sides in any prescribed sequence.

By means of the above described configuration, the line drivers and logic are referenced to the sustain level, and thus referenced to each other. The interface coupling means is provided to permit communication between a coded data source and the selection logic which in turn communicates with the line drivers.

Figure 2A:
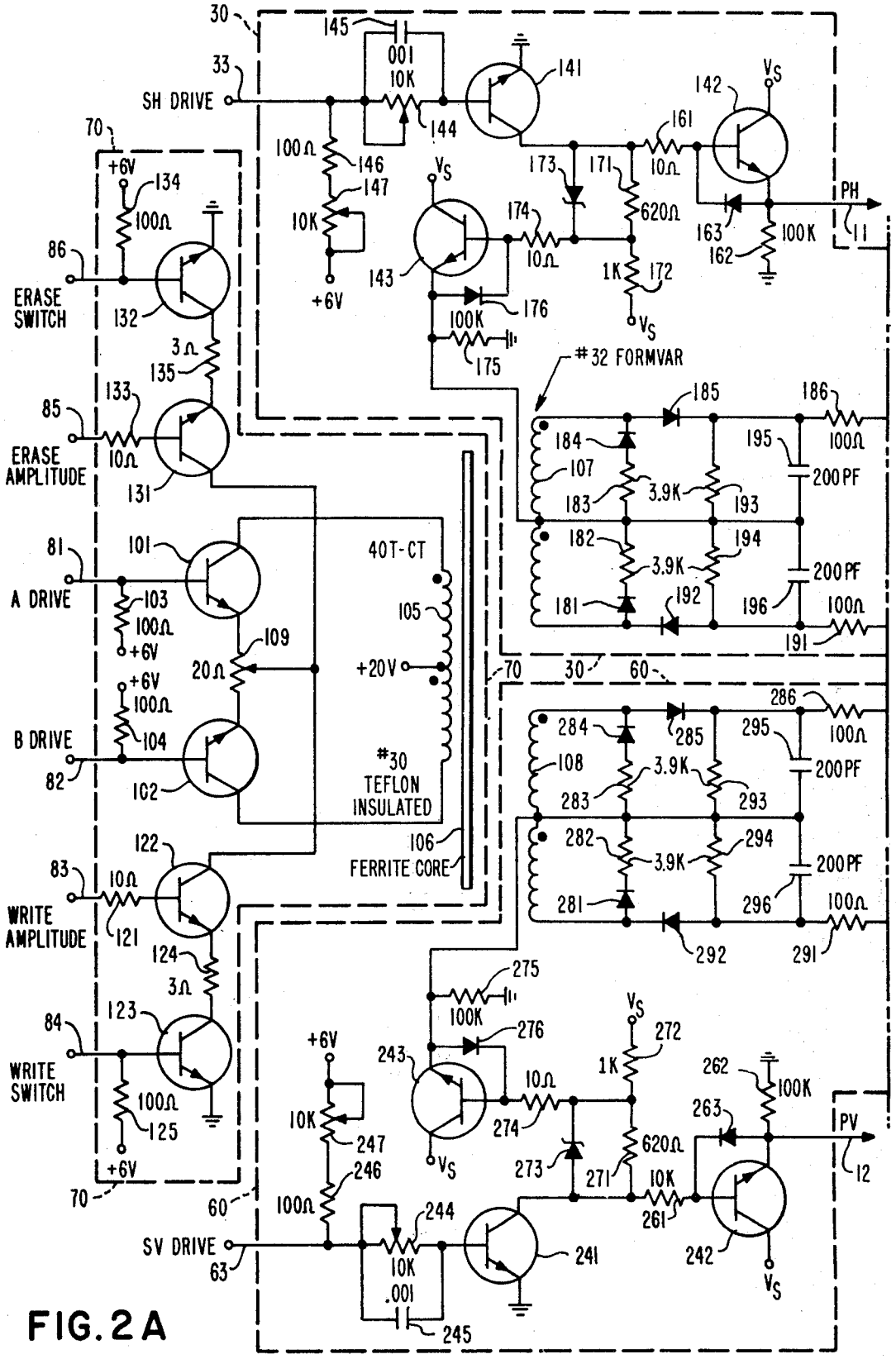
FIG. 2A and 2B illustrate in detail some of the system components shown in block form in FIG. 1.
Figure 2B:
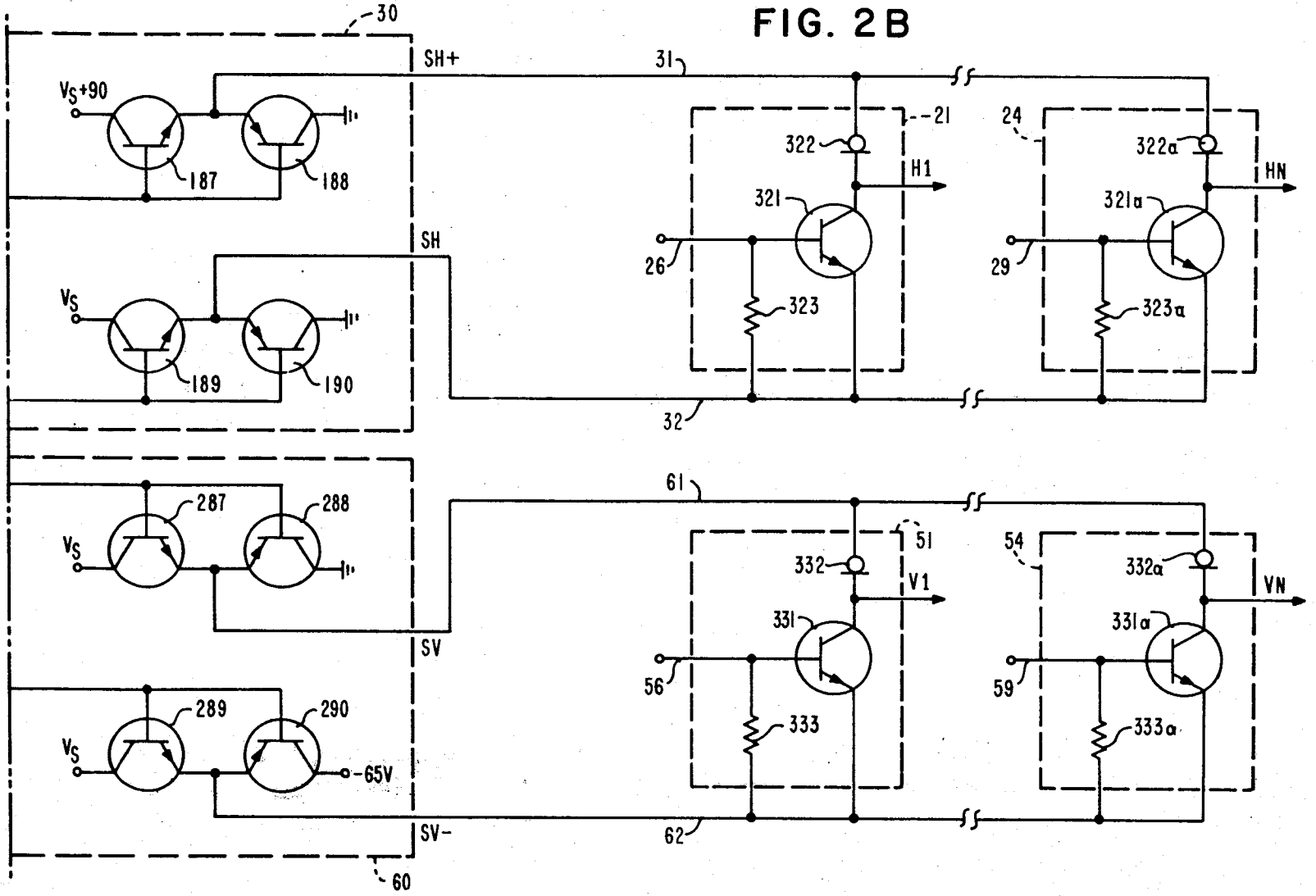

Reference is made next to FIGS. 2A and 2B which illustrate in detail the sustain driver 30, the sustain driver 60, the erase and write control circuit 70, and the line drivers illustrated in block form in FIG. 1. FIGS. 2A and 2B should be arranged as illustrated in FIG. 2C. The lines 81 and 82 in FIG. 2A are connected to the base of respective transistors 101 and 102. The resistors 103 and 104 are connected between the respective lines 81 and 82 to sources of potential. The collector electrodes of the transistors 101 and 102 are connected to the opposite ends of a primary winding 105 which has its center tap connected to a source of operating potential. The primary winding 105 is coupled through a magnetic core 106 to secondary windings 107 and 108. A resistor 109 is connected between the emitters of the transistors 101 and 102.

The control line 83 in FIG. 2A is connected through a resistor 121 to the base of a transistor 122. The collector of a transistor 123 is connected through a resistor 124 to the emitter of the transistor 122. The control line 84 is connected to the base of the transistor 123, and a resistor 125 is connected from the base of the transistor 123 to a source of potential. The control line 83 is connected to a fixed but adjustable potential (from 0 to 6V) to control the amplitude of the write pulses. When the transistor 123 is turned on by a signal on the control line 84, the transistor 122 is turned on and controlled as a current source by the potential on line 83. The magnitude of the current source is controlled by the magnitude of the positive potential on the control line 83. The transistors 122 and 123 are operated into the conductive state whenever a write operation is to be performed. Whenever both of the transistors 122 and 123 are operated, they serve as a controlled current source and a switch which connects the variable tap on the resistor 109 to ground.

Control lines 85 and 86 in FIG. 2A receive control signals during an erase operation which simultaneously operate transistors 131 and 132 into the conductive state. The control line 85 is connected through a resistor 133 to the base of the transistor 131. The control line 86 is connected to the base of the transistor 132. The base of the transistor 132 is connected through a resistor 134 to a source of potential. A resistor 135 is connected between the emitter of the transistor 131 and the collector of the transistor 132. Whenever an erase operation takes place, the control line 86 is energized to operate the transistors 131 and 132 simultaneously, and they serve as an adjustable current source and switch which then connects the variable tap on the resistor 109 to ground.

Next, the sustain driver 30 in FIGS. 2A and 2B is discussed. A pulse train, designated SH drive, on the control line 33 operates the transistor 141 the output of which (1) drives the transistor 142 to provide drive signals on the line 11 for the purpose of igniting and maintaining the ignition of the pilot cells and (2) drives the transistor 143, connected to the center tap of the secondary winding 107, for the purpose of providing output signals on the busses 31 and 32 thereby to operate the line drivers 21 through 24 in FIG. 2B.

The control line 33 in FIG. 2 is connected through an RC circuit to the base of the transistor 141. The RC circuit includes a resistor 144 and a condenser 145. The control line 33 is connected through resistors 146 and 147 to a source of potential. The collector of the transistor 141 is controlled through a resistor 161 to the base of the transistor 142. The emitter of the transistor 142 is connected through a resistor 162 to ground. A diode 163 is connected between the emitter and the base of the transistor 142. The emitter of the transistor 142 is connected to the horizontal drive line 11 which provides horizontal drive for the pilot cells P1–P4.

The collector of the transistor 141 in FIG. 2A is connected through resistors 171 and 172 to a source of operating potential. A Zener diode 173 is connected across the resistor 171. A resistor 174 is connected between the base of the transistor 143 and the junction point of the resistors 171 and 172. The emitter of the transistor 143 is connected through a resistor 175 to ground, and the emitter is connected also to the center tap of the secondary winding 107. A diode 176 is connected between the emitter and the base of the transistor 143. The collector of the transistor 143 is connected to a source of operating potential.

A series circuit including a diode 181 and a resistor 182 is connected across the lower half of the secondary winding 107, and a series circuit including a resistor 183 and a diode 184 is connected across the upper half of the secondary winding 107. The upper end of the secondary winding 107 is connected through a diode 185 and a resistor 186 to the base electrodes of transistors 187 and 188. A pair of transistors 189 and 190 have their base electrodes connected through a resistor 191 and a diode 192 to the lower end of the secondary winding 107. Resistors 193 and 194 are connected in parallel with respective condensers 195 and 196, as shown.

A pulse train, designated SV drive, on the line 63 in FIG. 2A operates the transistor 241 the output of which (1) operates the transistor 242 to supply drive signals on the vertical drive line 12 which provides vertical drive for the pilot cells P1 through P4 in FIG. 1 and (2) operates the transistor 243 to supply output signals on the busses 61 and 62 thereby to operate the line drivers 51 through 54 in FIG. 2B.

The line 63 in FIG. 2 is connected through an RC circuit to the base of the transistor 241. The RC circuit includes a resistor 244 and a condenser 245. The line 63 is connected through resistors 246 and 247 to a source of potential. The collector of the transistor 241 is connected through a resistor 261 to the base of the transistor 242. The emitter of the transistor 242 is connected through a resistor 262 to ground. A diode 263 is connected between the base and the emitter of the transistor 242. The emitter of the transistor 242 is connected to the drive line 12, and the collector is connected to a source of operating potential.

The collector of the transistor 241 is connected through the resistors 271 and 272 to a source of operating potential. A Zener diode 273 is connected across the resistor 271. A resistor 274 is connected between the base of the transistor 243 and the junction of the resistors 271 and 272. A resistor 275 is connected between the emitter of the transistor 243 and ground. A diode 276 is connected between the emitter and the base of the transistor 243. The emitter of the transistor 243 is connected to the center tap of the secondary winding 108, and the collector is connected to a source of operating potential.

A series circuit including a diode 281 and a resistor 282 is connected across the lower half of the secondary winding 108, and a series circuit including a resistor 283 and a diode 284 is connected across the upper half of the secondary winding 108. A diode 285 and a resistor 286 are connected in series to the base electrodes of transistors 287 and 288. Transistors 289 and 290 have their base electrodes connected through a resistor 291 and a diode 292 to the lower end of the secondary winding 108. Resistors 293 and 294 are connected in parallel with respective condensers 295 and 296, as shown.

Figure 3:
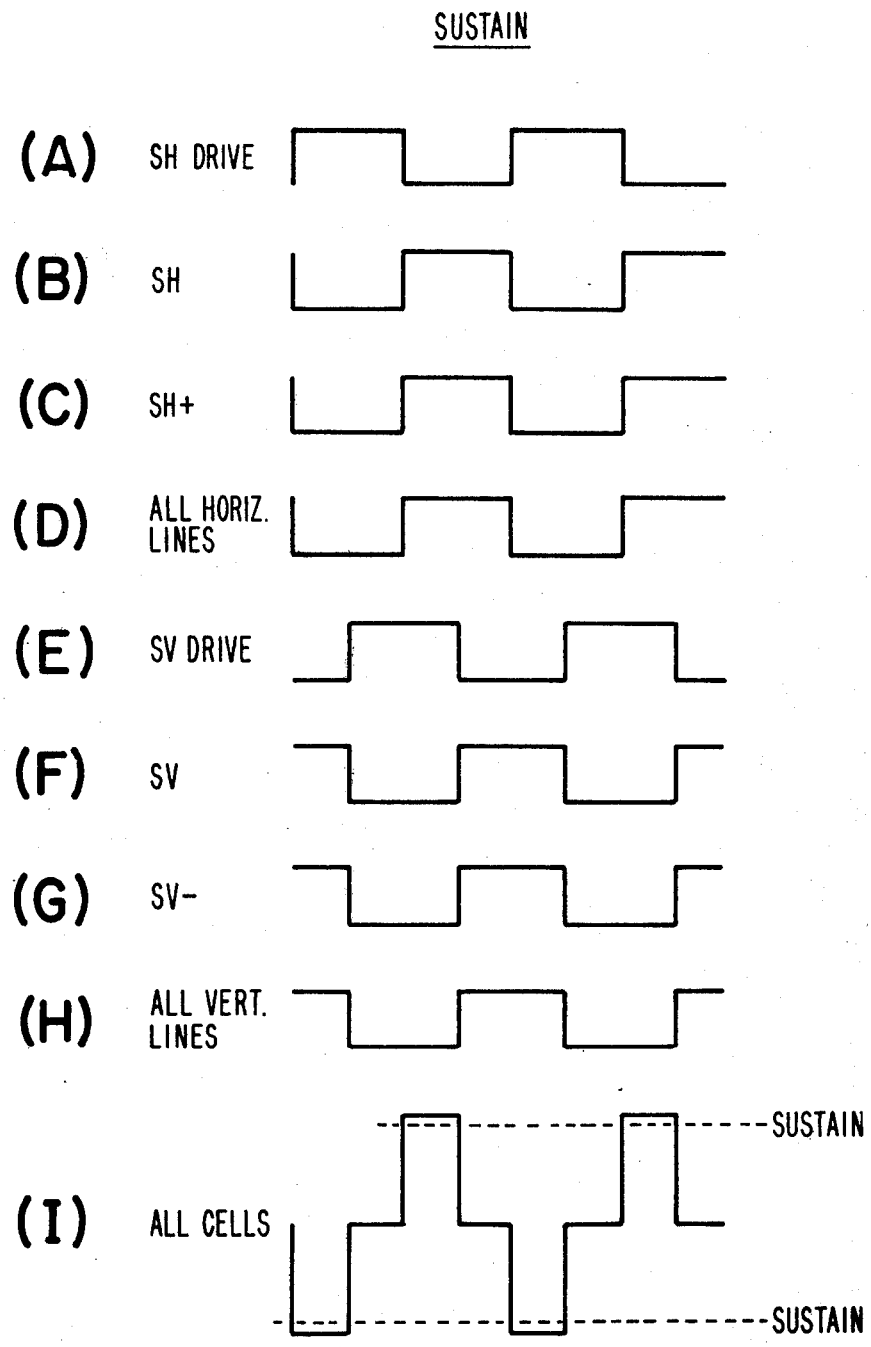
FIG. 3 (A–I) shows waveforms which are helpful in explaining a sustain operation.
Figure 4:
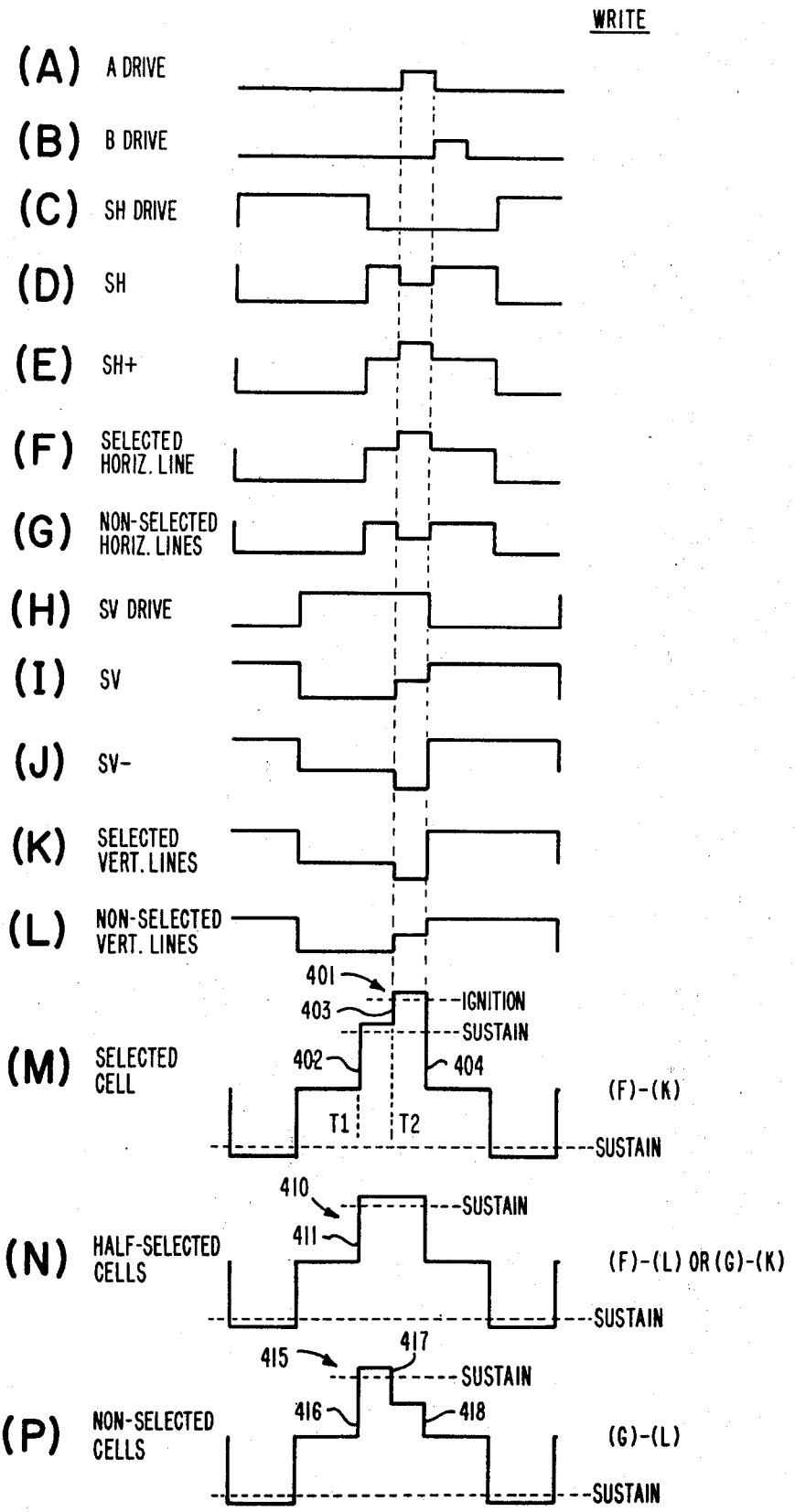
FIG. 4 (A–N, P) shows waveforms which are helpful in explaining a write operation.

Reference is made next to FIG. 2B which illustrates in detail the line drivers 21 through 24 shown in block form in FIG. 1. In FIG. 2B the line drivers 21 and 24 are arbitrarily illustrated. The line driver 21 includes a transistor 321 with a constant current diode 322 connected between the collector and the drive line 31. The emitter of the transistor 321 is connected to the drive line 32. The base of the transistor 321 is connected by the line 26 to the horizontal selection circuits 25 in FIG. 1. A resistor 323 is connected between the base of the transistor 321 and the drive line 32. The drive line Hl is connected to the collector of the transistor 321. The line driver 24 in FIG. 3 is identical in construction to the line drive 21, and the same reference numerals are used with the letter "a" affixed to designate corresponding parts.

FIG. 2B also illustrates in detail the vertical line drivers 51 through 54 shown in block form in FIG. 1. Line drivers 51 and 54 are arbitrarily illustrated. The line driver 51 includes a transistor 331. The emitter of the transistor 331 is connected to the drive line 62, and the collector of the transistor 331 is connected through a constant current diode 332 to the drive line 61. The collector of 331 is connected also to the drive line VI. The base of the transistor 331 is connected by the line 56 to the vertical selection circuits 55 in FIG. 1. A resistor 333 in FIG. 2B is connected between the base of the transistor 331 and the drive line 62. The vertical line driver 54 is identical in construction to the vertical line driver 51, and like reference numerals with the letter "*a*" affixed are used to designate corresponding parts.

The system in FIG. 1 is operated to display information on the gas panel 10 by igniting selective cells to form letters, numerals, and characters of any desired configuration. Information is written on the panel by igniting a selected pattern of gas cells. The potential difference supplied across the selected cells exceeds the ignition potential for a write operation. Information, once written, is sustained in the ignited state by sustain signals applied to all horizontal and vertical lines. The sustain signal on the horizontal and vertical lines creates a potential difference between such lines which is less than the ignition level but greater than the sustain level, thereby to maintain lighted patterns of gas cells in the ignited state. Information is erased by reducing the potential difference across a selected cell below the sustain level for a given period of time which time period varies with the mixture of gasses employed in the gas panel, and the sustain signal is applied again thereby to reignite all gas cells, except the erased gas cell, which previously were ignited. Next the operation of the system in FIG. 1 is discussed.

Sustain operations are described first. For this purpose reference is made to FIGS. 1, 2A and 2B for the circuits and FIG. 3 (A–I) for the waveforms. The SH drive signals on the line 33 in FIG. 2A are a square wavetrain such as shown in FIG. 3A. The SH drive signals on the line 33 in FIG. 2A are inverted by the transistor 141. The inverted SH drive signals undergo current amplification in the transistor 142, connected in an emitter follower configuration, and the output signals are supplied on the line 11 to the pilot gas cells P1 through P4 in FIG. 1. The inverted SH drive signals likewise undergo current amplification in the transistor 143, connected in an emitter-follower configuration, and they are supplied through the center tap of the secondary winding 107, through the resistor 186 to the base electrodes of the pair of transistors 187 and 188 which serve as a complementary pair of emitter-followers. The output signals on the bus 31, designated SH+, are supplied to the line drivers 21 and 24 in FIG. 2B. This SH+ signal is illustrated in FIG. 3C. The signals supplied to the center tap of the secondary winding 107 are supplied also through the resistor 191 to the base of the transistors 189 and 190 which likewise are connected as a pair of complementary emitter-followers. The output signals from the transistors 189 and 190 on the bus 32, designated SH, are supplied to the line drivers 21 and 24. These signals have the same magnitude and polarity as the SH+ signals on the bus 31. The SH signal is shown in FIG. 3B.

The signals SH+ and SH on the respective busses 31 and 32 are supplied to the respective collector and emitter electrodes of the transistors 321 and 321A in FIG. 2B. The SH+ signals are supplied through the constant current diodes 322 and 322A to the collector electrodes of the respective transistors 321 and 321A. For a sustain operation the horizontal selection circuit 25 in FIG. 1 need not supply a selection signal level on a selected one of the lines 26 through 29 to a respective one of the line drivers 21 through 24. If it does, however, no harm results for reasons pointed out below. If deselect signals are supplied on the lines 26 through 29 in FIG. 1, they have a given magnitude which is sufficiently more positive than the SH signal to cause the transistors in the drivers 26 through 29 to conduct. Consequently the transistors 321 and 321A in FIG. 2B conduct, and the signals on the lines Hl and HN have a polarity and magnitude equal to the SH signal on the bus 32. Incidentally, when transistors 321 and 321A are off, the magnitude of the signals on the lines H1 and HN have the same polarity and magnitude of the signals SH+ except for a slight voltage drop in the constant current diodes 322 and 322A, and it is seen therefore that it is inconsequential for sustain operation, as pointed out above, whether or not the transistors in the drivers 21 through 24 are on or off, i.e., selected or deselected by the horizontal selects circuit 25. The lines H2 and H3 in FIG. 1 are supplied with sustain signals by the associated line drivers 22 and 23 which are identical in polarity and magnitude to the signals supplied to the lines H1 and HN as explained with reference to FIG. 2B. The sustain signal supplied to the horizontal lines H1 through HN is illustrated in FIG. 3D. It is readily seen by inspection that the waveform in FIG. 3D is like the waveforms of FIGS. 3B and 3C.

The SV drive signal applied to the line 63 in FIG. 2A is a square wave train as illustrated in FIG. 3E. The SV drive signal is identical to the SH drive signal except the SV drive signal is 90° behind the SH drive signal. This signal is inverted by the transistor 241. The inverted output from the transistor 241 undergoes current amplification in the transistor 242, connected in an emitter-follower configuration, and its output is supplied on the line 12 to the pilot cells P1 through P4 in FIG. 1. The inverted output signal from the transistor 241 is likewise supplied to the base of the transistor 243 which also is connected in an emitter-follower configuration to provide current amplification. The output of the transistor 243 is connected to the center tap of the secondary winding 108, through the resistor 286 to the base electrodes of the transistors 287 and 288 in FIG. 2B which are connected as a pair of complementary emitter-followers to provide current amplification. The output signals SV from the transistors 287 and 288 on the bus 61 is a square wave train as shown in FIG. 3F. The output signal from the transistor 243 in FIG. 2A is connected to the center tap of the secondary winding 108, through the resistor 291 to the base electrode of the transistors 289 and 290 which likewise are connected as a complementary pair of emitter-followers to provide current amplification. The output signals SV– from the transistors 289 and 290 on the bus 62 is a square wave train as illustrated in FIG. 3G. The signal SV and the signal SV− on the respective busses 61 and 62 have the same magnitude and polarity as readily seen by inspection of FIGS. 3F and 3G. The SV signal on the line 61 in FIG. 2B is supplied through the constant current diodes 332 and 332A to the collector electrodes of the respective transistors 331 and 331A. The SV− signal on the line 62 in FIG. 2B is supplied to the emitter electrodes of the transistors 331 and 331A. For a sustain operation the vertical selection circuit 55 in FIG. 1 may or may not supply a selection level on one of the lines 56 through 59 to a respective one of the line drivers 51 through 54. If a selection level is supplied to a given one of the line drivers 51 through 54, it is inconsequential for reasons pointed out above. Let it be assumed that deselection levels are supplied. Referring more specifically to the line drivers 51 and 54 in FIG. 2B, such deselection signals on the lines 56 and 59 drive the respective transistors 331 and 331A to the non-conductive or off state. For this purpose the signal levels on the lines 56 and 59 may have the same magnitude and polarity as the SV−signal on the bus 62. The transistors 331 and 331A accordingly are driven off during a sustain operation, and the signals on the lines Vl and VN are substantially identical in polarity and magnitude to the SV signal on the bus 61 except for a slight potential drop through the respective constant current diodes 332 and 332A. The signals on the lines V1 and VN are a square wave train as illustrated in FIG. 3H. Sustain signals of the identical polarity and magnitude as that illustrated in FIG. 3H are supplied by the line drivers 52 and 53 in FIG. 1 to the vertical lines V2 and V3.

The potential difference between the horizontal lines H1 through HN and the vertical lines V1 through VN at each coordinate intersection of the gas panel 10 in FIG. 1 must exceed the sustain level for the particular gas, or mixture of gases, employed in the gas panel. The potential on each horizontal lines, taken alone, is sufficient to equal or exceed the sustain level of the gas cells at each coordinate intersection of the gas panel in FIG. 1, but has only one polarity and the potential on each vertical lines, taken alone, is likewise sufficient to equal or exceed the sustain level of the gas cells at each coordinate intersection of the gas panel 10 in FIG. 1 but has the opposite polarity. However, the potential on each horizontal line and the potential on each vertical line, taken together, provide an alternating potential difference across the gas panel 10 at each coordinate intersection which equals or exceeds the sustain level of the particular gas or mixture of gasses employed. The potential on each of the horizontal lines of the gas panel in FIG. 1 is a square wave train as illustrated in FIG. 3D, and the potential on each of the vertical lines is a square wave train as illustrated in FIG. 3H. The resulting potential difference across each gas cell of the panel in FIG. 1 is a square wave train as illustrated in FIG. 3I. The waveform in FIG. 3I is obtained by subtracting the wave form in FIG. 3H from the waveform in FIG. 3D. The sustain level is indicated by dotted lines in FIG. 3I. The square waves in FIG. 3I exceed the sustain level on both the positive and the negative excursions. Each one of the positive or negative excursions is sufficient to maintain all previously ignited cells in the illuminated state. However, the positive and negative excursions in FIG. 3I are not sufficient to ignite any cell previously in the non-illuminated state.

Next a write operation is described. The waveforms in FIG. 4 (A–N, P) are helpful in explaining the events which take place in the circuits of FIGS. 1, 2A and 2B during a write operation. For a write operation the frequency of the SH drive signal and the SV drive signal is reduced substantially below the frequency these signals having during a sustain operation. In one arrangement according to this invention a gas mixture of 99.9% Neon and 0.1% Argon was employed in the gas panel. The frequency used for the SH drive signal and the SV drive signal was 30 kilohertz per second for sustain operations. The frequency of the SH drive signal and the SV drive signal was reduced to 15 kilohertz per second for a write operation. It is a feature of this invention to perform sustain operations at all times, even during write operations, on all previously ignited cells. In other words, sustain operations on all ignited cells are carried out at all times except when a particular one of the ignited cells is selected for an erase operation. The SH and SV drive signals provide the voltage waveforms to the cells of the display panel in FIG. 1 which perform a sustain operation on all previously ignited cells during a write operation, and during such operation a selected dark or non-illuminated cell is ignited. Square waves are applied across the cells of the panel in FIG. 1 for this purpose. It is seen, therefore, that during a write operation the square waves perform two functions i.e. sustain and write. The leading edge of a square wave potential difference applied across a previously ignited gas cell performs a sustain operation. It is necessary that the leading edge of the square wave rise to an amplitude equal to or in excess of the sustain signal level of the gas cell, and it is desirable that the write operation take place at a subsequent point in time. This time delay permits the plasma discharge activity of the sustained gas cells to settle down, and a write operation then may take place with the least disturbance on adjacent dark or non-illuminated cells. For this reason the write operation is timed to take place near the termination of a square wave signal applied to the selected cell. It is for the purpose of providing an extension of the period of time between the leading edge of a square wave pulse which provides for the sustain function and the latter part of a square wave which provides for the writing function that the frequency of the SH and SV drive signals is reduced for a writing operation. The ignited gas cells tend to settle about 4-8 microseconds after a sustain operation, the precise time depending upon the mixture of gasses used. For the particular gas mixture mentioned above a frequency of 30 kilocycles per second for the SH drive signal and the SV drive signal is adequate to perform sustain operations, and a frequency of 15 kilocycles per second is adequate for write operation. The lower frequency provides the needed time differential between the leading edge of the square wave potential difference applied to the gas cells for a sustain operation and the latter part which provides for a write operation.

For a write operation the SH drive signal applied to the line 33 in FIG. 2A is shown in FIG. 4C, and it is readily seen by inspection that the pulses are twice as wide as the SH drive signal shown in FIG. 3A. The SH drive signal on line 33 provides the corresponding inverted signals SH in FIG. 4D and SH− in FIG. 4E on the lines 31 and 32 in FIG. 2B as explained above. A given one of the line drivers 21 through 24 in FIG. 1 is selected during a write operation, and the remaining ones of these line drivers are deselected. The selected line driver is driven off, and the deselected line drivers are driven on. For this purpose the selected line driver receives a signal on the associated one of the lines 26 through 29 from the horizontal selection circuit 25 which is equal to or less than the SH drive signal on the bus 32. The deselected line drivers receives signals on the associated lines 26 through 29 which are positive with respect to the SH drive signal on the bus 32.

If the line driver 21 in FIG. 2B is selected, it receives a signal on the line 26 which is equal to or less than the SH signal on the bus 32, and the transistor 321 is driven off. In this case the line drivers 22 through 24 in FIG. 1 are deselected. The line driver 24 in FIG. 2B accordingly receives a signal on the line 29 which is more positive than the SH signal on the bus 32, and the transistor 321A is driven on. The corresponding transistor in the line drivers 22 and 23 in FIG. 1 are driven on. Since the transistor 321 of the selected line driver 21 is off, the waveform of the signal on the selected line H1 follows the waveform of the signal SH+ on the bus 31 except for a slight voltage drop across the constant current diode 322. The waveform of the signal on the selected line H1 is illustrated in FIG. 4F. The signal on each of the non-selected horizontal drive lines is illustrated in FIG. 4G. Referring to the line driver 24 in FIG. 2B, the transistor 321A is conductive, and the signal on the non-selected line HN follows the waveform of the signal SH on the bus 32.

The SV drive signal on the line 63 in FIG. 2A is illustrated in FIG. 4H. The SV drive signal is identical to the SH drive signal except the SV drive signal is 90° behind the SV drive signal. The SV drive signal provides the SV and the SV− signals on the respective busses 61 and 62 in FIG. 2B for reasons explained above. The waveform of the SV signal is shown in FIG. 4I, and the waveform of the SV−signal is shown in FIG. 4J.

For a write operation a given one of the vertical line drivers 51 through 54 in FIG. 1 is selected, and the remaining ones of these line drivers are deselected. The select and deselect signals are supplied by the vertical selection circuit 55 in FIG. 1 on the lines 56 through 59. The selected vertical line driver is driven on, and the deselected line drivers are driven off. Referring to FIG. 2B, the transistor 331 is driven on if the line driver 51 is selected. For this purpose the selection signal on the line 56 is made more positive than the SV− signal on the bus 62. Consequently, the transistor 331A is driven off. The waveform of the signal on the selected line V1 in FIG. 2B follows the waveform of the signal SV− on the bus 62 since the transistor 331 is conductive. The waveform of the signal on the selected vertical line Vl is illustrated in FIG. 4K. The waveform of the signal on the non-selected vertical lines V2 through V4 is illustrated in FIG. 4L, and they are identical to the waveform of the signal SV on the bus 61 except for a slight voltage drop through the associated constant current diodes. The line driver 54, for example, in FIG. 2B has its transistor 331A driven off, and the waveform on the non-selected line VN follows the waveform of the signal SV on the bus 61 except for a slight voltage drop through the constant current diode 332A.

For a write operation the erase and write control circuit 70 in FIG. 2A receives a positive signal, designated write amplitude, on the line 83 which establishes the magnitude of constant current generated by the transistor 122 when it is in the conductive state. A positive signal, designated write switch, is applied on the line 84 to drive the transistor 123 into the conductive state. When the transistor 123 is conductive, then the transistor 122 will be conductive. If the transistors 122 and 123 are conductive, a path is provided from the center tap of the resistor 109 to ground. A positive A drive pulse, shown in FIG. 4A, is applied on the line 81. The positive A drive pulse on the line 81 drives the transistor 101 into the conductive state, and current flows from the voltage source connected to the center tap of the primary winding 105 through the upper half of the primary winding 105, the transistor 101, through the resistor 109 to the center tap, and then through the transistor 122, the resistor 124, and the transistor 123 to ground. The magnitude of the current in the upper half of the primary winding 105 is controlled by current source transistor 122. This controlled current pulse induces a pulse signal in the secondary windings 107 and 108. The signal induced in the secondary winding 107 is algebraically added on the inverted SH drive signal supplied to the center tap of the secondary winding 107. This algebraically added pulse causes the upper end of the secondary winding 107 to become more positive than the center and lower end of the secondary winding 107. The Diode 185 passes the composite signal through the resistor 186 to the base of the transistors 187 and 188. This composite signal, SH+, is then connected to bus 31, and is illustrated in FIG. 4E. Since the lower end of the winding 107 is driven negatively, the diode 192 passes this composite signal through the resistor 191 to the base of the transistors 189 and 190 in FIG. 2B. This composite signal, SH, is then connected to bus 32, and this is illustrated in FIG. 4D. Since the selected horizontal line has a waveform which follows the waveform of the SH+ signal on the bus 31, the effect of the algebraically added pulse is to increase in a positive direction the signal on the selected horizontal line. This is shown in FIG. 4F. The waveform of the signal on the non-selected horizontal lines follows the waveform of the SH signal on the bus 32, and the effect of the algebraically added pulse is to decrease in a negative direction the signal on the non-selected horizontal lines. This is shown in FIG. 4G.

The A drive pulse on the line 81 in FIG. 2A causes a signal to be induced in the secondary winding 108 the polarity of which is positive at the upper end of the winding 108 and negative at the lower end. The induced positive signal at the upper end of the secondary winding 108, algebraically added to the inverted SV drive signal applied to the center tap of the secondary winding 108, is passed by the diode 285 in FIG. 2A through the resistor 286 to the base of the transistors 287 and 288 in FIG. 2B. This composite signal, SV, is then connected to bus 61. Since the SV drive signal is negative at this time, the induced positive pulse increases the magnitude of the SV waveform as shown in FIG. 4I.

The induced negative signal at the lower end of the secondary winding 108, algebraically added to the inverted SV drive signal applied to the center tap of the secondary winding 108, is passed by the diode 292 through the resistor 291 to the base of the transistors 289 and 290 in FIG. 2B. This composite signal, SV−, is then connected to bus 62, and the net effect is to drive the bus 62 more negative as illustrated in FIG. 4J. The waveform of the potential on the selected vertical line is illustrated in FIG. 4K. The waveform of the potential on the selected vertical line follows the waveform of the SV−signal as explained above. Consequently, the effect of the induced negative pulse is to drive the selected vertical line more negatively as shown in FIG. 4K.

The waveform of the signals on the non-selected vertical lines follows the waveform of the SV signal on the bus 61 as explained above. The waveform of the signals on the non-selected vertical lines is illustrated in FIG. 4I, and the effect of the induced positive pulse is to increase the magnitude of the potential on the non-selected vertical lines.

The potential difference between the horizontal and vertical lines at the coordinate intersection of the selected cell is shown in FIG. 4M. This waveform is obtained by subtracting the signal on the selected vertical line from the signal on the selected horizontal line. The signal on the selected horizontal line is illustrated in FIG. 4F, and the signal on the selected vertical line is illustrated in FIG. 4K. By subtracting the waveform in FIG. 4K from the waveform in FIG. 4F, the result is the waveform in FIG. 4M. The effect of the induced pulse, resulting from the A drive pulse, is to increase the potential difference across the selected cell, and the amplitude of the induced pulse is sufficient to exceed the ignition level indicated by the dotted line in FIG. 4M. It is pointed out that the termination of the induced pulse in FIG. 4M coincides with the termination of the waveform representing the potential difference applied across the selected cell. The positive pulse 401 in FIG. 4M has a first leading edge 402 and a second leading edge 403. The leading edge 402 occurs at time T1, and the leading edge 403 occurs at time T2. At time T1 sustain operations take place in all cells except the selected cell which is dark for a write operation. At time T2 a write operation in the selected cell commences. The leading edge 403 initiates the writing operation, and the writing operation is terminated by the trailing edge 404 of the pulse 401. The time delay between the time T1 and the time T2 is sufficient to permit the gas mixture in the sustained non selected cells to settle sufficiently for a writing operation to commence at time T2 without danger of "spilling" taking place. Spilling refers to the undesirable and unintentional ignition of a dark cell near the selected cell during a writing operation. This might tend to occur because the violent plasma discharge activity of the gasses in a nearby sustained cell is followed closely by the violent plasma discharge activity of the gasses of a nearby selected cell during a write operation.

The signal level applied to half-selected cells is shown in FIG. 4N, and this waveform results from the potential difference obtained by subtracting the waveform in FIG. 4L from the waveform in FIG. 4F or subtracting the waveform in FIG. 4K from the waveform in FIG. 4G. The half-selected cells are those cells on the selected vertical line other than the selected cell and the cells on the selected horizontal line other than the selected cell. To illustrate, the selected cell is cell (V1, H1) whenever the lines H1 and V1 are selected. In this case the half-selected cells are all of the cells on the horizontal line H1 except the selected cell (H1, V1) and all of the cells on the vertical line V1 except the selected cell (H1, V1). The non-selected cells are the remaining cells in FIG. 1 in this case. More specifically, the non-selected cells are all cells except those cells lying along the line H1 or the line V1. The potential difference across the non-selected cells is a waveform illustrated in FIG. 4P. This waveform is the result of the potential difference obtained by subtracting the waveform in FIG. 4L from the waveform in FIG. 4G. The positive pulse 410 in FIG. 4N has a leading edge 411 which performs a sustain operation in the half-selected cells, and the positive pulse 415 in FIG. 4P has a leading edge 416 which performs a sustain operation in the non-selected cells. It is pointed out that the waveforms in FIGS. 4M, 4N and 4P are identical to the sustain wave form in FIG. 3I except for the effect of the induced pulse which increases the amplitude at pulse 401 in FIG. 4M and decreases the amplitude of the pulse 415 in FIG. 4P. The increased amplitude of the pulse 401 in FIG. 4M is required to exceed the ignition potential of the selected cell thereby to perform a write operation of igniting the selected cell. In this connection it is pointed out that the induced pulse increases the potential difference across the selected, and only the selected, cell. The amplitude of the waveform across the half-selected cells, shown in FIG. 4N, is not changed by the induced pulse. In fact, the waveform of FIG. 4N is identical to the waveform of FIG. 3I except for the change in width of the pulses resulting from the use of a lower frequency during a write operation.

The effect of the induced pulse in a writing operation on the waveform of the potential difference applied across the non-selected cells is shown in FIG. 4P, and the pulse 415 has a first trailing edge 417, occuring earlier than the trailing edge 418, displaced in time as shown. The trailing edge 417 occurs earlier than the trailing edge 418 because the induced pulse causes both the non-selected vertical lines to increase and the non-selected horizontal lines to decrease in potential. However, as pointed out above with respect to FIG. 4M, the sustain operation for the ignited, non-selected cells commences at the time T1 and terminates at the time T2, and the positive excursion of the pulse 415 in FIG. 4P is sufficient in amplitude and duration to perform a sustain operation during a writing operation of the non-selected cells which were previously ignited.

After the A drive pulse on the line 81 in FIG. 2A terminates, a B drive pulse, shown in FIG. 4B, is applied to the line 82 in FIG. 2A for the purpose of resetting the ferrite core 106. When the A drive pulse on the line 81 terminates, the transistor 101 changes to the non-conductive state. The positive B drive pulse on the line 82 drives the transistor 102 into the conductive state, and current flows from the voltage source at the center tap of the primary winding 105 through the lower half of this winding, the transistor 102, the resistor 109 to its center tap, the transistor 122, the resistor 124, and the transistor 123 to ground. The current through the lower portion of the primary winding 105 resets the ferrite core 106, and signals are induced in the secondary windings 107 and 108. The polarity of the induced pulse drives the lower end of the windings 107 and 108 positively, and it drives the upper ends of these windings negatively. The diode 185 blocks the induced negative signal, and the diode 192 blocks the induced positive signal, thereby preventing the induced signal from affecting the signals on the busses 31 and 32 in FIG. 2B. In like fashion the diode 285 in FIG. 2A blocks the induced negative signal, and the diode 292 blocks the induced positive signal, thereby preventing the induced signal from affecting the signals on the busses 61 and 62 in FIG. 2B. The diode 184 in FIG. 2A conducts, and the induced negative signal is dissipated in the resistor 183. The diode 181 conducts and the resistor 182 dissipates the induced positive signal. The diode 284 conducts and the resistor 283 dissipates the induced negative signal. The diode 281 conducts and the resistor 282 dissipates the induced positive signal. Consequently, the B drive signal resets the ferrite core 106 without affecting the control signals supplied to the busses 31 and 32 and the busses 61 and 62 in FIG. 2B. As soon as the B drive pulse terminates, the positive signal, designated write switch, on the line 84 is removed if there are no further writing operations. If further writing operations are to take place, the horizontal selection circuit 25 in FIG. 25 selects a given one of the line drivers 21 through 24, and the vertical selection 55 selects one of the line drivers 51 through 54. An A drive pulse and a B drive pulse are applied in the manner previously explained to perform another writing operation in a different selected cell. A series of writing operations may be performed because sustain takes place during writing operations. When all writing operations have been completed, the positive signal, designated write switch, on the line 84 in FIG. 2A is removed, and the frequency of the SH drive signal and the frequency of the SV drive signal is changed back to the higher frequency for sustain operations which continue automatically thereafter. It is pointed out by way of interest that sustain operations may take place automatically without resetting the horizontal and vertical selection circuits. It was pointed out above that sustain operations are not affected by the state, selected or deselected, of the horizontal and vertical line drivers. Such is the case because after a writing operation is finished the waveforms on the busses 31 and 32 are identical, and the waveform of the output signal on the horizontal lines Hl through HN must be like that on the bus 31 or the bus 32. Likewise, the waveform on the bus 61 is identical to the waveform on the bus 62, and the waveforms on the vertical lines Vl through VN must follow the waveform of the signal on the bus 61 or the waveform of the signal on the bus 62.

Figure 5:
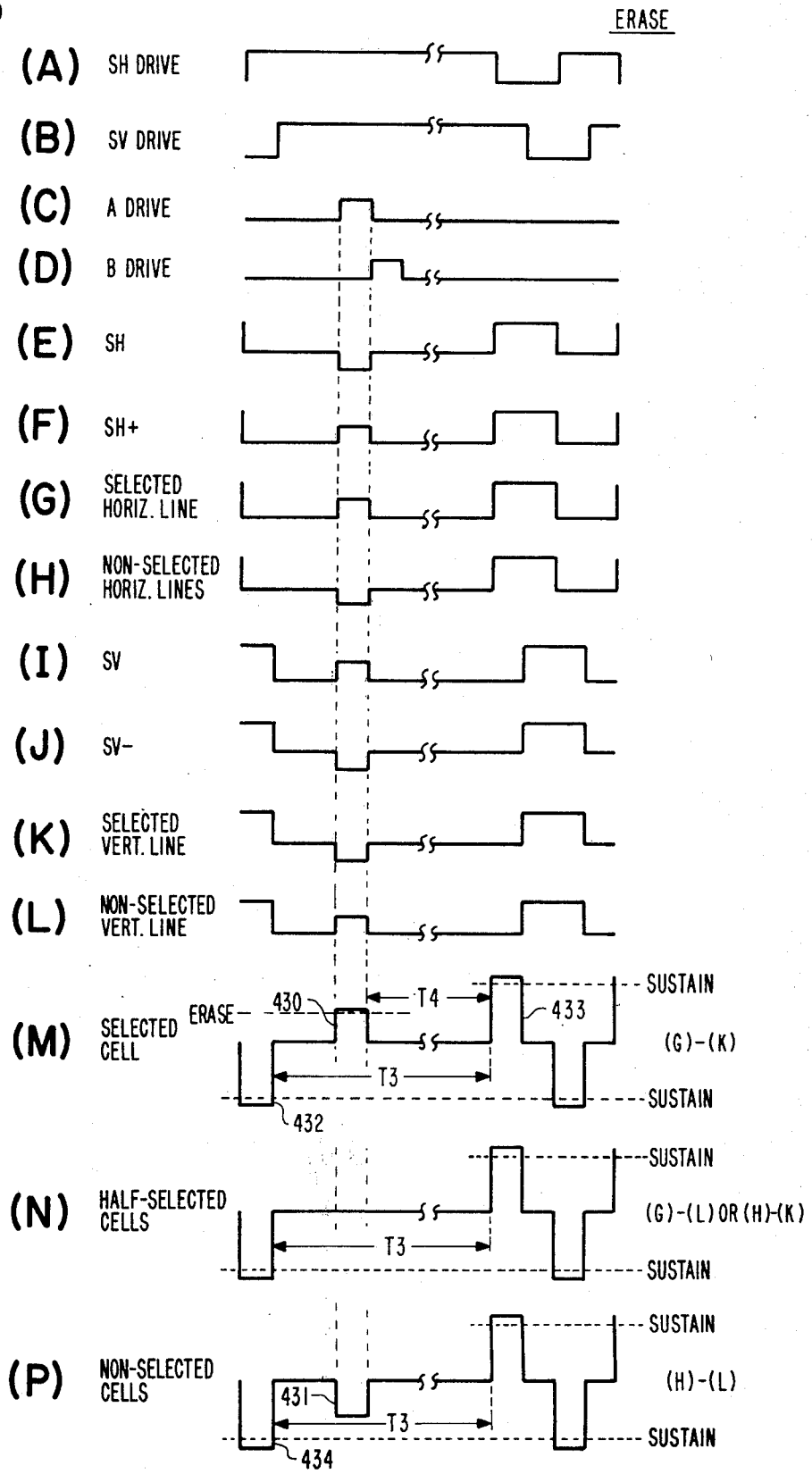
FIG. 5 (A–N, P) shows waveforms which are helpful in explaining an erase operation.

An erase operation, used to extinguish a selected ignited gas cell on the gas panel 10 in FIG. 1 is described next. For an erase operation the horizontal selection circuit 25 in FIG. 1 selects one of the line drivers 21 through 24 and deselects the remaining ones of these line drivers. The vertical selection circuit 55 selects one of the line drivers 51 through 54 and deselects the remaining ones of these line drivers. FIG. 5 (A-N, P) illustrates waveforms during an erase operation.

Whenever an erase operation takes place, the SH drive signal on the line 33 in FIG. 2A and the SV drive signal on the line 63 are latched up on their next positive excursions as shown in FIGS. 5A and 5B. A positive adjustable voltage, designated erase amplitude, is applied on the line 85 in FIG. 2A, and it controls the current source transistor 131. A positive signal, designated erase switch, is applied on the line 86, and consequently the transistors 132 and 131 become conductive.

Since the SH drive signal on the line 33 in FIG. 2A is latched up as shown in FIG. 5B, this causes the inverse or down signals to be supplied on the busses 31 and 32 for reasons previously explained. The inverse levels of the SH drive signal in FIG. 2A are shown in FIGS. 5E and 5F. Since the SV drive signal on the line 63 in FIG. 2A is latched up, this causes an inverted or down level to be established on the busses 61 and 62 for reasons previously explained. The inverse levels of the SV drive signal in FIG. 2B are shown in FIGS. 5I and 5J.

A positive A drive pulse is applied to the line 81 in FIG. 2A, and this drives the transistor 101 into the conductive state. Current flows from the voltage source connected to the center tap of the primary winding 105 through the upper half of this primary winding, the transistor 101, the upper half of the resistor 109, the transistor 131, the resistor 135, and the transistor 132 to ground. A positive pulse is induced in the upper half of the windings 107 and 108 which are combined with sustain and supplied to the busses 31 and 61 in FIG. 2B in the manner previouly explained. Negative pulses are induced in the lower half of the windings 107 and 108 which are combined with sustain and supplied to the busses 32 and 62 in FIG. 2B in the manner previously explained. The A drive signal is shown in FIG. 5C. The induced negative pulse on the bus 32 in FIG. 2B is shown in FIG. 5E, and the induced positive pulse on the bus 31 in FIG. 2B is shown in FIG. 5F. The induced positive pulse on the bus 61 in FIG. 2B is shown in FIG. 51, and the induced negative pulse on the bus 62 in FIG. 2B is shown in FIG. 5J.

The selected one of the horizontal line drivers 21 through 24 in FIG. 1 has its transistor driven into the non-conductive state by a select signal level on one of the lines 26 through 29, and the remaining ones of the horizontal line drivers 21 through 24 are driven into the conductive state by deselect signals on the remaining ones of the lines 26 through 29. If, for example, the horizontal line driver 21 in FIG. 2B is selected, the transistor 321 is driven off, and the signal on the selected horizontal line H1 follows the waveform of the signal on the bus 31 except for a slight voltage drop through the constant current diode 322. The waveform of the signal on the selected horizontal line H1 is shown in FIG. 5C. Since the horizontal line driver 24 in FIG. 2B is not selected, the transistor 321A is driven into the conductive state, and the waveform of the signal on the horizontal line HN follows the waveform of the signal on the bus 32. Likewise, the remaining non-selected horizontal lines H2 and H3 follow the waveform of the signal on the bus 32. Each of the non-selected horizontal lines has a signal with the waveform shown in FIG. 5H.

The vertical selection circuit 55 in FIG. 1 supplies a select signal level on one of the lines 56 through 59 which drives the transistor of the selected one of the line drivers 51 through 54 into the conductive state, and the remaining ones of the vertical line drivers 51 through 54 receive deselect signals on the associated ones of the lines 56 through 59 which drives their associated transistors into the non-conductive state. For example, if the line driver 51 in FIG. 2B is selected, the transistor 331 is driven into the conductive state, and the signal on the selected vertical line V1 follows the signal on the bus 62. The waveform of the signal on the selected vertical line V1 is shown in FIG. 5K. The waveform of the signal on each of the non-selected vertical lines V2 through VN is shown in FIG. 5L. For example, if the vertical line driver 54 in FIG. 2B is deselected, the transistor 331A is driven into the non-conductive state, and the signal on the line VN follows the signal on the bus 61 except for a slight voltage drop through the constant current diode 322A.

The selected gas cell on the panel 10 in FIG. 1 receives a potential difference having the waveform shown in FIG. 5M during an erase operation. A positive pulse 430 represents the potential difference applied across the selected gas cell as the result of the A drive pulse in FIG. 5C. The waveform in FIG. 5M is obtained by subtracting the waveform in FIG. 5K from the waveform in FIG. 5G. The waveform in FIG. 5N represents the potential difference applied across the half-selected cells, and this waveform is obtained by subtracting the waveform in FIG. 5L from the waveform in FIG. 5G or subtracting the waveform of FIG. 5K from the waveform of FIG. 5H. The A drive signal in FIG. 5C has no effect on the half-selected cells during an erase operation because the induced signals on the horizontal and vertical lines in question have a cancelling effect. The potential difference applied across the non-selected cells has the waveform shown in FIG. 5P, and this waveform results from subtracting the wave form in FIG. 5L from the waveform in FIG. 5H. The A drive signal causes a pulse 431 in FIG. 5P to be applied across the non-selected cells. This pulse, however, is uneventful as pointed out hereinafter.

The positive pulse 430 in FIG. 5M is applied across the selected gas cell as a result of the A drive pulse. The pulse 430 does not have sufficient amplitude to perform a sustain operation but it does have sufficient amplitude to perform an erase operation. The selected gas cell last was sustained by the negative pulse 432 in FIG. 5M. Since the positive pulse 430 drives the gas mixture of the selected gas cell with a signal of a polarity opposite to that of the last sustain pulse 432, the pulse 430 thereby produces a weak avalanche or plasma discharge and reduces the wall charge of the selected gas cell almost to zero. Upon expiration of the time T4 in FIG. 5M the selected gas cell has lost the remaining wall charge due to decay, and its discharge activity has subsided. Consequently, the selected gas cell remains dark or unlighted. The polarity of the pulse 430 should always be opposite to that of the last sustain pulse 432 when performing an erase operation. The time period T3 in FIG. 5N and FIG. 5P is a relatively long period, but it is not sufficiently long for the previously ignited cells to be reignited by the positive sustain pulses which arrive at the end of the time period T3. The pulse 431 in FIG. 5M is uneventful because the polarity of this pulse is the same as the polarity of the last sustain pulse 434, and the pulse 431 does not cause any avalanche and therefore does not change the cell history. The characteristic ability of the previously ignited non-selected cells to reignite in response to a sustain signal at the end of the time period T3 remains unchanged. Thus it is seen that the selected cell is extinguished by the end of the time period T4, and the remaining cells in the gas panel 10 are reignited at the end of the time period T3 if they were previously ignited.

It is pointed out that if all cells were absolutely uniform, the erase pulse would not have to be followed by a dead time since the erase pulse would have reduced the wall charge (or memory) to zero, but all cells are not uniform in a practical panel. Therefore, some residual wall charge, however small, still remains. The dead time then allows this residual wall charge to decay to zero. The erase operation thus is made uniform even with non uniform cells. The non selected cell will still retain enough wall charge (even though decay takes place therein also during dead time) to reignite after the dead time.

Upon termination of the A drive pulse in FIG. 5C, the transistor 101 reverts to the non-conductive state, and a B drive pulse shown in FIG. 5D, is applied to the line 82 in FIG. 2A which drives the transistor 102 into the conductive state. Current flows from the voltage source connected to the center tap of the primary winding 105 through the lower half of this winding, the transistor 102, the lower half of the resistor 109, the transistor 131, resistor 135, and the transistor 132 to ground. The ferrite core 106 is reset. Signals induced into the secondary windings 107 and 108 are dissipated, as previously explained, without affecting the signals on the busses 31 and 32 or the busses 61 and 62. Positive signals on the lines 85 and 86 in FIG. 2A are removed, and the erase operation is terminated. In FIG. 5 (A-N, P) the erase operation terminates at the end of the time period T3, and waveforms shown in the right hand section perform sustain operations as previously explained.

The transistors 321, 321*a*, 331 and 331*a*, of the respective line drivers 21, 24, 51, and 54 have very low power requirements since their primary function is to superimpose an induced signal of relatively low power and voltage on the drive lines as the result of the A drive pulse supplied to the line 81 in FIG. 2A. Since the transistors in the line drivers of FIG. 2B have relatively low power requirements, the circuit components of the line drivers may be fabricated using integrated circuit techniques. The use of integrated circuits reduces the cost of construction particularly in devices of this type where the total number of horizontal and vertical lines may number in the thousands. The transistors in the sustain driver 30 and the sustain driver 60 in FIGS. 2A and 2B are of the high voltage, medium power type since they must handle the power requirements for the high voltage signals supplied to the busses 31, 32, 61 and 62. However, it is pointed out that the number of these transistors is and fixed for any practical display system thereby minimizing the cost.

It is seen, therefore, that a novel method and apparatus for a gas panel display system are provided according to this invention. Variations in the shape of the applied SH drive and SV drive signals may be made. The constant current diodes in FIG. 2B may be replaced by collector resistors buffered by emitter follower transistors with diodes connected from base to emitter to assist negative transistions, or any other collector load configuration presenting a relatively low output impedance. The constant current diode was used to illustrate just one such law output impedance configuration.

While the invention has been particularly shown and described with reference to a preferred embodiment thereof, it will be understood by those skilled in the art that the foregoing and other changes in form and detail may be made therein without departing from the spirit and scope of the invention.

What is claimed is:

1. In a gas discharge device comprising a pair of support plates having dielectric coated conductor arrays thereon said conductor arrays being oriented relative to each other to define a plurality of separately addressable discrete discharge sites, the improvements comprising, circuit means for supplying a periodic sustaining potential to all said conductor arrays, logic circuit and high voltage pulse producing means referenced to said periodic sustaining potential for selectively generating high voltage pulses and algebraically adding same to said periodic sustaining potential on selected ones of said conductors in said arrays, and means for providing low voltage address control signals to said logic circuit means for controlling said high voltage pulse producing means.

2. Apparatus of the type claimed in claim 1 wherein said logic circuit means comprises selector circuit means for selecting group and sub-group conductors and controlling the distribution of said high voltage pulses from said high voltage pulse producing means to said selected group and sub-group conductors.

3. Apparatus of the type claimed in claim 1 wherein said logic circuit and said high voltage pulse producing means are connected to electrically float on said periodic sustaining potential whereby said periodic sustaining potential functions as a reference level for said logic circuit and said high voltage pulse producing means.

4. Apparatus of the type claimed in claim 1 wherein said means for providing said low voltage address control signals to said logic circuit means comprise magnetic coupling means.

5. Apparatus of the type claimed in claim 1 wherein said high voltage pulse producing means comprises a pulse transformer for generating said high voltage pulses and switching means for directing said high voltage pulses to said selected conductors in said arrays.

6. Improved panel control circuits according to claim 5, wherein said bistable switching means comprises selection logic means which is powered by low level supply voltages floating in relation to the voltage amplitudes of said sustain, write and erase drive signals, and high voltage switching circuits connected between common sources of said drive signals and said respective row and column conductors.

7. In a gas discharge device comprising a pair of support plates having transverse conductor arrays on opposite sides thereof and insulated from contact with the gas by a thin layer of insulating means, the intersections of said conductors being oriented to define gaseous discharge sites, and means joining said support plates in spaced relation to define a gas discharge panel between said plates, the improvement comprising means for producing and applying a periodic sustaining signal to said conductor arrays, and logic circuit means responsive to address control signals for selecting said gaseous sites to be discharged.

said logic circuit means and an associated low voltage power supply being referenced to said periodic sustaining signal whereby said sustaining signal functions as a floating reference level for said logic circuit means and said associated low voltage power supply.

8. Apparatus of the type claimed in claim 7 further including coupling means for isolatingly coupling said address control signals to said logic circuit means.

9. In a gaseous discharge panel in which a gas discharge medium under pressure in a thin gas discharge chamber bounded by a pair of parallel dielectric charge storage members, respectively, backed by row conductor and column conductor arrays wherein the discharge conditions of selected discharge sites defined by cross points of selected row and column conductors are manipulated by selectively applied high voltage pulses and discharges, once initiated, are sustained by relatively high sustaining voltage applied to all said row and column conductors and wherein said sustaining voltage is supplied to said conductor arrays such that said panel floats with respect to a point of common potential and said selectively applied high voltage pulses have as a reference level the instantaneous magnitude of said relatively high sustaining voltage, the improvements comprising a low voltage source of direct current potential, said low voltage potential source having as a reference level the magnitude of said relatively high sustaining voltage, selector circuit means having latching logic circuit elements for selecting row and column conductors, respectively, and high voltage circuit means for generating said high voltage pulses, a plurality of switching circuits associated with said row and column conductors respectively, said selector circuit means, said high voltage circuit means and said switching circuits being interconnected to apply said discharge condition manipulating high voltage pulses to said selected discharge sites, said selector circuit means having as its sole source of operating potential said low voltage source of direct current potential, said switching circuit having as its sole source of operating potential said high voltage pulse, and coupler circuit means for isolatingly coupling a coded discharge site selection signal from a data source to said selector circuit.

10. A solid state system for controlling the selective transfer of high voltage pulses to multiple conductor arrays in accordance with intelligence represented by low voltage signal functions comprising:

a source of low voltage logic signals operating in timed coordination with the source of said high voltage pulses for designating the high voltage pulse conditions to be transferred selectively to said conductors in each of said arrays upon occurrence of the next succeeding high voltage pulse, circuit means with isolation capability coupled directly to said low voltage signal source for translating said low voltage intelligence signals selectively into multiple low voltage control signals while isolating said source electrically from high voltage electrical pulses; and multiple bistable switching means coupled directly to said individual conductors in at least one of said arrays, to said low and high voltage sources and to said translating-isolation circuit, said switching means being subject to bistable preconditioning in accordance with the low voltage electrical control signals.

11. In a system for controlling operations of a gas discharge display panel in which multiple conductor lines traversing multiple discharge sites are used to convey high voltage drive signals to said sites in order to effect writing, erasing and sustaining functions relative to said sites and in which said drive pulses fluctuate in amplitude level and duration relative to said sites, the improvement comprising:

multiple bistable drive switching means coupled between said conductor lines and the source of said drive pulses to control coupling of said drive pulses to said conductor lines in accordance with bistable conditions thereof, a source of low level conditioning signals, and circuit means coupled between said source and said switching circuits for preconditioning said switching circuits in accordance with signals supplied by said low level source, said drive switching circuits and pre-conditioning circuit means being provided with isolation circuits preventing said drive pulses from exerting conditioning or disturbing influence upon said switching circuits and said low level source.

12. A system for controlling operating of a gas discharge display panel having multiple conductor arrays traversing discrete discharge sites and conveying drive signals to said sites, said signals serving to effect writing, erasing, and sustaining functions relative to such sites, said system comprising:

a source of low level information pulses occurring prior to a writing or erasing sequence, multiple bistable switching means coupled to individual lines in said conductor arrays for selectively controlling application of said drive signals to the respective lines in accordance with bistable conditions thereof, and means for preconditioning said multiple switching means in accordance with the intelligence of such information signals to provide selective simultaneous discharge of a plurality of discharge sites.

13. A system of the type claimed in claim 12 wherein said means for preconditioning said multiple switching means includes isolation circuit means preventing said drive signals from influencing said source of low level information signals through reflection of signals into said through said switching means and through said preconditioning means.

* * * * *